US008413708B2

(12) United States Patent
Furukawa et al.

(10) Patent No.: US 8,413,708 B2
(45) Date of Patent: Apr. 9, 2013

(54) CASTING MOLD SURFACE TREATMENT METHOD

(75) Inventors: Yuichi Furukawa, Toyota (JP); Fumio Kawahara, Toyota (JP); Hidenori Matsuoka, Nagoya (JP); Hitoshi Kabasawa, Omiya (JP)

(73) Assignees: Toyota Jidosha Kabushiki Kaisha, Toyota-shi (JP); MEC International Co., Ltd., Toyota-shi (JP)

( * ) Notice: Subject to any disclaimer, the term of this patent is extended or adjusted under 35 U.S.C. 154(b) by 0 days.

(21) Appl. No.: 13/553,136

(22) Filed: Jul. 19, 2012

(65) Prior Publication Data

US 2012/0288622 A1 Nov. 15, 2012

Related U.S. Application Data

(62) Division of application No. 13/056,520, filed as application No. PCT/JP2009/063559 on Jul. 30, 2009, now Pat. No. 8,256,493.

(30) Foreign Application Priority Data

Jul. 31, 2008 (JP) ..... 2008-198588

(51) Int. Cl.
*B22C 3/00* (2006.01)

(52) U.S. Cl.
USPC ..... 164/72

(58) Field of Classification Search ..... 164/267, 164/472, 14, 33, 72, 138; 249/114.1, 115; 977/734, 902
See application file for complete search history.

(56) References Cited

U.S. PATENT DOCUMENTS

| | | | | |
|---|---|---|---|---|
| 8,256,493 | B2 * | 9/2012 | Furukawa et al. | 164/267 |
| 2008/0206444 | A1 | 8/2008 | Matsuo et al. | |
| 2009/0117359 | A1 | 5/2009 | Yoshimi et al. | |
| 2010/0215985 | A1 | 8/2010 | Kitano | |

FOREIGN PATENT DOCUMENTS

| | | |
|---|---|---|
| JP | 2006 306010 | 11/2006 |
| JP | 2006 327892 | 12/2006 |
| JP | 2007 100210 | 4/2007 |
| JP | 2007 119903 | 5/2007 |
| JP | 2007 144499 | 6/2007 |
| JP | 2007 146274 | 6/2007 |
| JP | 2007 217517 | 8/2007 |
| JP | 2008 105082 | 5/2008 |

(Continued)

OTHER PUBLICATIONS

International Search Report issued Oct. 27, 2009 in PCT/JP09/063559 filed Jul. 30, 2009.

(Continued)

*Primary Examiner* — Kevin P Kerns
(74) *Attorney, Agent, or Firm* — Oblon, Spivak, McClelland, Maier & Neustadt, L.L.P.

(57) ABSTRACT

A surface treatment method includes covering a surface of a casting mold with a carbon film containing at least one type of nanocarbon selected from the group including carbon nanocoils, carbon nanotubes and carbon nanofilaments, and further applying fullerenes to that surface. With this surface treatment method being performed on a surface (a cavity surface, etc. of a casting mold) making contact with a molten casting material such as aluminum, etc., sticking of the molten casting material to the mold is inhibited, release resistance of the product is reduced, and release effectiveness is improved. The release effectiveness lasts longer than in the case of a conventional carbon film.

5 Claims, 4 Drawing Sheets

FOREIGN PATENT DOCUMENTS

WO 2008 139880 11/2008

OTHER PUBLICATIONS

International Preliminary Report on Patentability (English translation only) issued Aug. 18, 2010, in International Application No. PCT/JP2009/063559 (International filing date Jul. 30, 2009).

European Search Report mailed on Apr. 4, 2012 in the corresponding application No. EP09803012.5.

M. Monthioux, et al., "Hybrid carbon nanotubes: Strategy, progress, and perspectives", Journal of Materials Research, vol. 21, No. 11, Nov. 2006, pp. 2774-2793.

* cited by examiner

CASTING MOLD SURFACE TREATMENT METHOD

CROSS REFERENCE TO RELATED APPLICATIONS

This application is a divisional of U.S. application Ser. No. 13/056,520, filed Jan. 28, 2011, which issued as U.S. Pat. No. 8,256,493 and which is incorporated herein by reference. U.S. application Ser. No. 13/056,520 is the National Stage of PCT/JP2009/063559, filed Jul. 30, 2009 and claims priority to Japanese Patent Application 2008-198588, filed Jul. 31, 2008.

TECHNICAL FIELD

The present invention relates to a casting mold surface treatment method, and a casting mold having a carbon film formed on its surface by this surface treatment method.

BACKGROUND ART

A casting technique for molding a product using a casting mold is a technique capable of producing products in large quantities with a consistent shape and quality, and is used in manufacturing products using a variety of materials. In the casting process, a die lubricant is generally applied to a molding surface of the casting mold, by which the product is released more easily when the molded product is to be removed from the casting mold. However, when casting is repeated, the material may stick to the casting mold, and removing the product from the casting mold becomes more difficult.

For example, when aluminum alloy, etc. is to be cast by a die casting method, molten aluminum is filled rapidly into a metal cavity under high pressure. Molten metal may stick to the portion of the casting mold making contact with the molten aluminum, and release resistance upon ejecting the product from the casting mold increases.

This problem can be resolved by covering the surface of the casting mold with a carbon film. The carbon film prevents the molten metal and the base material of the casting mold from making direct contact, suppressing the sticking of molten metal to the casting mold and an increase in release resistance. For example, in Patent Document 1, carbon material having fullerenes as its principal component is rubbed onto the surface of the casting mold used for aluminum die casting. This formed carbon film having fullerenes as its principal component on the surface of the casting mold reduces release resistance and prevents from sticking.

CITATION LIST

Patent Literature

Patent Document 1: Japanese Patent Application Publication No. 2007-144499

SUMMARY OF INVENTION

Technical Problem

According to the technique of Patent Document 1, although the carbon film having fullerenes as its principal component and formed on the casting mold surface need not be applied each time the casting process is performed, its effectiveness in reducing the release resistance is lost after the casting has been performed a certain number of times. When the effectiveness in reducing the release resistance has been lost, a maintenance operation of re-covering the casting mold with the carbon film having fullerenes as its principal component must be performed to restore the effectiveness of releasing the casting mold. From the viewpoint of increasing production efficiency, it is preferred that maintenance is less frequent, and that the release effectiveness, i.e., the effectiveness in reducing release resistance and preventing sticking, lasts longer.

Solution to Technical Problem

To deal with this, in the present invention, a casting mold surface treatment method is taught, which comprises applying fullerenes to a surface of a carbon film (termed "nanocarbon film" below), which covers a surface of a casting mold and contains at least one type of nanocarbon selected from the group of carbon nanocoils, carbon nanotubes and carbon nanofilaments.

When surface treating of the casting mold is performed using the surface treatment method of the present invention, the fullerenes are applied to the surface of the nanocarbon film covering the surface of the casting mold, thereby the fullerenes fills into spaces or asperities in the nanocarbon film. In the carbon film formed on the surface of the casting mold, the fullerene content at the surface side of the carbon film thus becomes greater than the fullerene content at the casting mold side. That is, more fullerenes are contained near the surface of the carbon film.

When the surface of the casting mold is covered by the carbon film containing fullerenes near the surface of the nanocarbon film, as described above, and casting is performed using this casting mold, release effectiveness can be retained longer.

Further, a surface treatment method of the present invention be termed as a casting mold surface treatment method including a nanocarbon film forming step of forming, on a surface of a casting mold, a carbon film containing at least one type of nanocarbon selected from the group of carbon nanocoils, carbon nanotubes and carbon nanofilaments, and a fullerene applying step of applying fullerenes to a surface of the nanocarbon film. That is, the surface treatment method of the present invention may include, prior to the fullerene applying step, the step of forming the carbon film containing nanocarbons on the surface of the casting mold.

According to the present invention, a carbon film with longer lasting release effectiveness can be formed on the surface of the casting mold. By making the release effectiveness last longer, maintenance of the casting mold can be reduced, and production efficiency in the casting process can be increased.

DESCRIPTION OF EMBODIMENTS

In the surface treatment method of the present invention, preferably, a casting mold whose surface has already been covered by a nanocarbon film may be obtained, and fullerenes may be further applied to this casting mold. Further, the surface treatment method may preferably include a step of forming a carbon film containing nanocarbons on the casting mold, and a step of applying fullerenes to the surface of the carbon film that contains nanocarbons.

A carbon film formed by the surface treatment method of the present invention includes fullerenes and at least one type of nanocarbon selected from the group of carbon nanocoils, carbon nanotubes and carbon nanofilaments. The carbon film formed by the surface treatment method of the present invention need not necessarily be composed only of carbon.

Fullerenes are carbon clusters having a closed shell structure, and normally have an even number of carbon atoms ranging from 60~130. Specific examples are: $C_{60}$, $C_{70}$, $C_{76}$, $C_{78}$, $C_{80}$, $C_{82}$, $C_{84}$, $C_{86}$, $C_{88}$, $C_{90}$, $C_{92}$, $C_{94}$, $C_{96}$ and higher-order carbon clusters having a greater number of carbon atoms. Apart from the above fullerenes, the fullerenes in the present invention include fullerene derivatives in which other molecules or functional groups have been chemically modified in the fullerene molecules. In the fullerene applying step, the fullerene application may be performed using a mixture of the fullerenes and other substances.

Preferred aspects of below embodiments will be listed.

1. In the fullerene applying step, a fullerene powder may be applied directly to the nanocarbon film.
2. In the nanocarbon film forming step, the nanocarbon film is formed, and a nitride film and a sulfurized film may be formed between the nanocarbon film and a treated base material.

EMBODIMENTS (Release Resistance Measurement Test)

Figure 2:
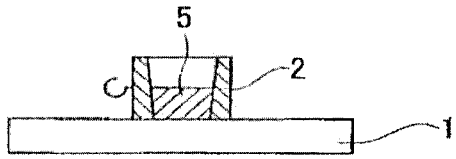
FIG. 2 explains the release resistance measurement test device used in the embodiments and comparative examples, and shows a casting of molten metal.
Figure 3:
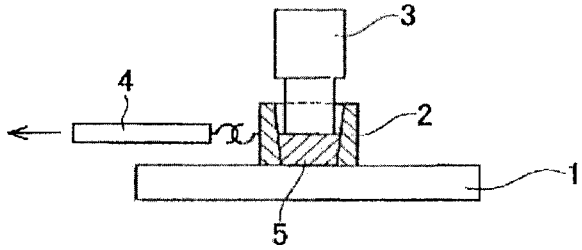
FIG. 3 explains the release resistance measurement test device used in the embodiments and comparative examples, and shows a measurement of an releasing load applied by tension.

A carbon film was formed on a steel surface according to Embodiment 1 and Comparative Examples 1~3, and the release resistance of a treated surface was measured using an automatic tension testing device Lub-Tester-U (MEC International). The Lub-Tester-U is a device in which, after a ring body 2 is positioned on a test bed 1 and molten aluminum 5 is poured into the ring body 2, as shown in FIG. 2, a weight 3 is positioned after the aluminum has solidified, as shown in FIG. 3, and frictional resistance while pulling the ring body 2 is measured by the device. The test bed 1 is manufactured from SKD61 (alloy tool steel: JIS G4404), and has the dimensions 200 mm×200 mm×30 mm. The surface treatment described below was performed on this test bed 1.

Embodiment 1

A nanocarbon film was formed on a surface of the test bed 1 by the following method. Moreover, the following method was taught in Japanese Patent Application Publication No. 2008-105082, and is a method for forming, on SKD61 steel, a carbon film (nanocarbon film) including at least one type of nanocarbon chosen from among the group of carbon nanocoils, carbon nanotubes and carbon nanofilaments.

Figure 4:
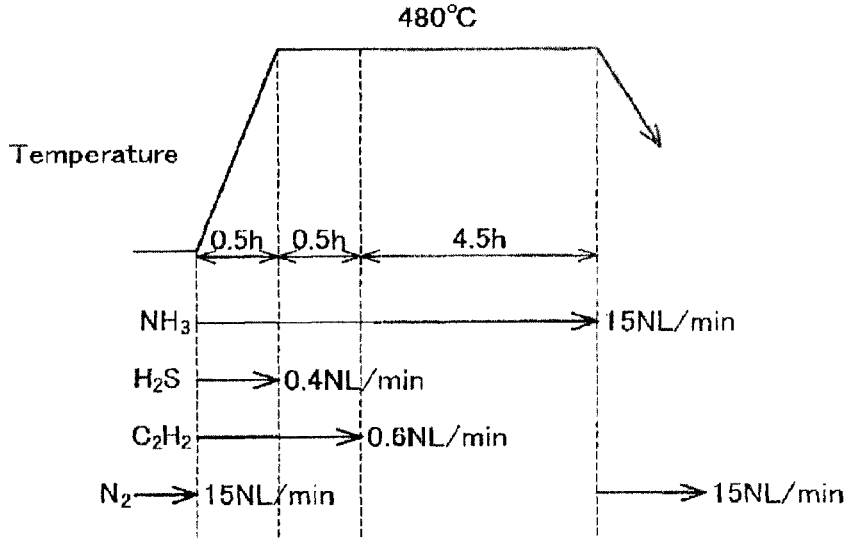
FIG. 4 is a profile of a nanocarbon film forming process of the embodiments and the comparative examples.

Nanocarbon Film Forming Process:

The test bed 1 was placed in an atmospheric furnace, air was purged using a vacuum pump, then nitrogen gas ($N_2$) was circulated to create an $N_2$ atmosphere. Next, in accordance with the process profile shown in FIG. 4, heating to 480° C. for 0.5 h was performed while reaction gas (hydrogen sulfide ($H_2S$) gas, acetylene ($C_2H_2$) gas, ammonia ($NH_3$) gas) was circulated. After 0.5 h from beginning the heating, when 480° C. was reached, supply of hydrogen sulfide gas was halted, then after a further 0.5 h, supply of acetylene gas was halted. The temperature was maintained at 480° C. for 4.5 h while the ammonia gas was circulated, then supply of the ammonia gas was halted, the supply of gas was switched to nitrogen gas, and cooling was started. A nanocarbon film was thus formed on the surface of the test bed 1, and a nitride film and sulfurized film were formed between the base material of the test bed 1 and the nanocarbon film.

In Embodiment 1, a fullerene applying process described below was further performed on the test bed 1 which had undergone the nanocarbon film forming process. Moreover, in Embodiment 1, fullerenes are applied to the surface of the nanocarbon film.

Fullerene Applying Process:

After the test bed 1 was heated once to 300° C., fullerene $C_{60}$ powder was applied to the nanocarbon film formed on the surface of the test bed 1 using a cloth to which the fullerene $C_{60}$ powder (nanom purple ST, manufactured by Frontier Carbon Corp.) had been applied. Sufficient fullerene powder was applied to the cloth, then the fullerene powder was applied to the entire nanocarbon film surface while pressing with an average pressure of 10~300 g/cm$^2$. Moreover, while the fullerene powder was being applied using the cloth, the temperature of the test bed 1 was between 100° C. and less than 300° C. Using this method, the quantity of fullerenes applied to the surface of the test bed was 1 mg/cm$^2$.

Comparative Example 1

Only the fullerene applying process described in Embodiment 1 was performed on the test bed 1 having the same material, shape, and size as Embodiment 1.

Comparative Example 2

Only the nanocarbon film forming process described in Embodiment 1 was performed on the test bed 1 having the same material, shape, and size as Embodiment 1, and the fullerene applying process was not performed.

Comparative Example 3

Surface treatment was performed on the test bed 1 having the same material, shape, and size as Embodiment 1, with the order of the nanocarbon film forming process and the fullerene applying process described in Embodiment 1 having been reversed. That is, first the fullerene applying process described in Embodiment 1 was performed on the test bed 1, forming the fullerene carbon film. Next, the nanocarbon film forming process described in Embodiment 1 was performed on the test bed 1 upon which the fullerene carbon film had been formed, forming the nanocarbon film on the surface of the fullerene carbon film.

Figure 1:
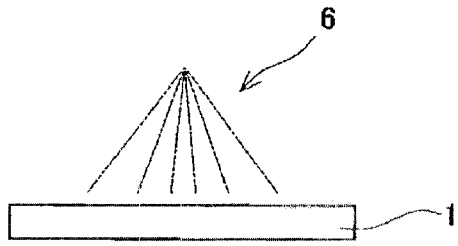
FIG. 1 explains a release resistance measurement test device used in the embodiments and comparative examples, and shows an application of a die lubricant.

Release Resistance Measurement Test:

The release resistance of the test bed 1, which had undergone surface treatment according to Embodiment 1 and Comparative Examples 1~3, was measured using an automatic tension testing device. The ring body 2 was manufactured from SKD61, had a height of 50 mm, and had an inner diameter 70 mm and an outer diameter 90 mm at the surface making contact with the test bed 1. The inner diameter of the ring body 2 increased slightly as it rose from the surface making contact with the test bed 1. ADC12 (aluminum alloy die casting JIS H5302) was used in the molten aluminum. As shown in FIG. 1, a conventionally used silicon emulsion die lubricant 6 was applied to the carbon film formed on the test bed 1 and, as shown in FIG. 2, the ring body 2 was mounted, 90 cc of molten aluminum (ADC12) at 650° C. was poured into the ring body 2, was cooled for 40 seconds, and allowed to solidify. Further, as shown in FIG. 3, a 9 kg iron weight 3 was mounted, and the releasing load was measured while pulling the ring body 2 at a constant speed of 50 mm/s using a push-pull 4. The release resistance measurement test was repeated using the test beds which had undergone the surface treatment of Embodiment 1 and Comparative Examples 1~3, and the changes in the releasing load were examined. The results are shown in FIG. 5.

Figure 5:
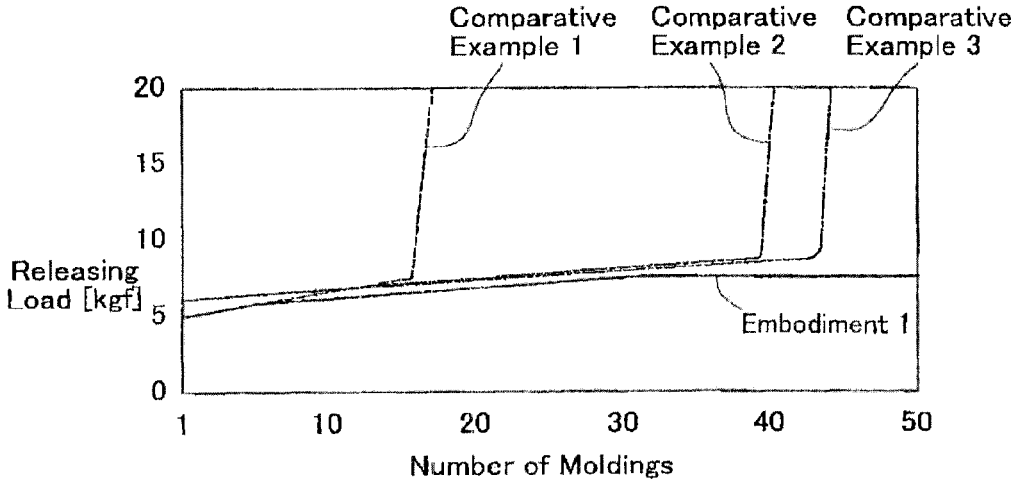
FIG. 5 shows release resistance measurement test results of the embodiments and the comparative examples.

In FIG. 5, the releasing load is on the vertical axis, and the number of implementations of the release resistance measurement test is shown on the horizontal axis as the number of moldings. In the test beds which had undergone the surface treatment of Comparative Examples 1~3, an almost constant releasing load of 5~8 kgf could be maintained for a certain number of moldings. However, the releasing load increased markedly when a certain number of moldings was reached, rapidly exceeding 20 kgf. By contrast, in the test bed which had undergone the surface treatment of Embodiment 1, a marked increase in releasing load, as in Comparative Examples 1~3, did not occur even when the number of moldings exceeded 50, and a low releasing load of 5~8 kgf was maintained.

The greater the number of moldings until a marked increase in the releasing load, the longer the releasing effect can be said to last. From the results shown in FIG. 5, it was found that the carbon film formed by the surface treatment method as in Embodiment 1 in which the nanocarbon film forming process is performed first and then the fullerene applying process is performed, has a longer release effectiveness than that formed by the surface treatment method as in Comparative Examples 1~3, in which only one of the processes is performed, and has a longer release effectiveness than that formed by the surface treatment method in which the order of the two processes is reversed.

Further, in Comparative Example 1 and Embodiment 1, the releasing load was nearly identical while the number of moldings was small (up to five), and was slightly less than in Comparative Example 2 and Comparative Example 3. It was conjectured that, since the outermost layer was covered by fullerenes in Comparative Example 1 and Embodiment 1, release resistance was reduced by the fullerenes. Further, in Comparative Example 2, although the releasing load was slightly greater than in Comparative Example 1 for a small number of moldings, the number of moldings until the releasing load increased markedly was more than twice that of Comparative Example 1. This was conjectured to be due to the nanocarbon film formed in Comparative Example 2 peeling off less readily than the carbon film, to which the fullerenes had been applied, of Comparative Example 1.

Figure 6:
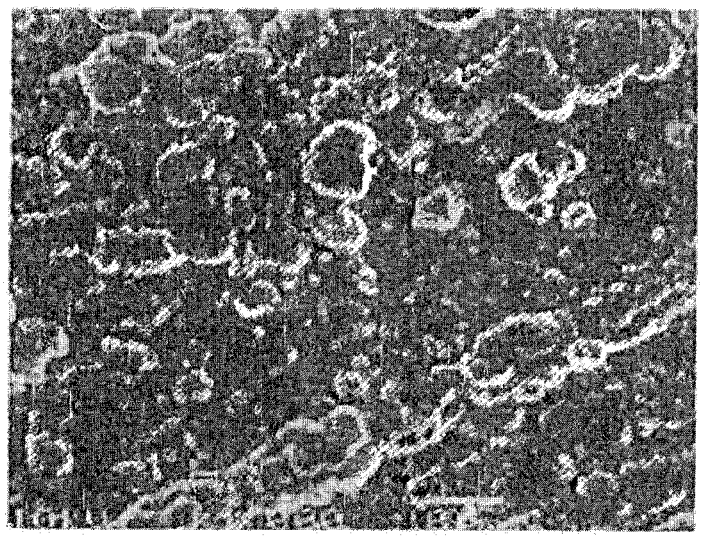
FIG. 6 shows an SEM image of a carbon film surface formed by the embodiments.
Figure 7:
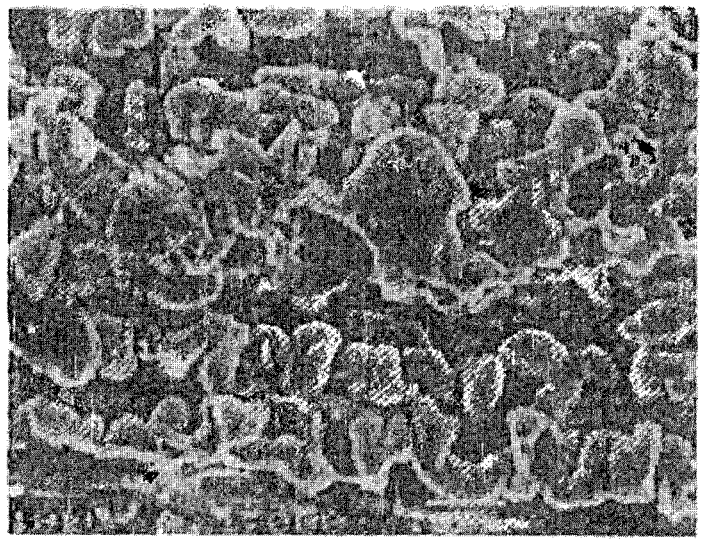
FIG. 7 shows an SEM image of a carbon film surface formed by the comparative examples.
Figure 8:
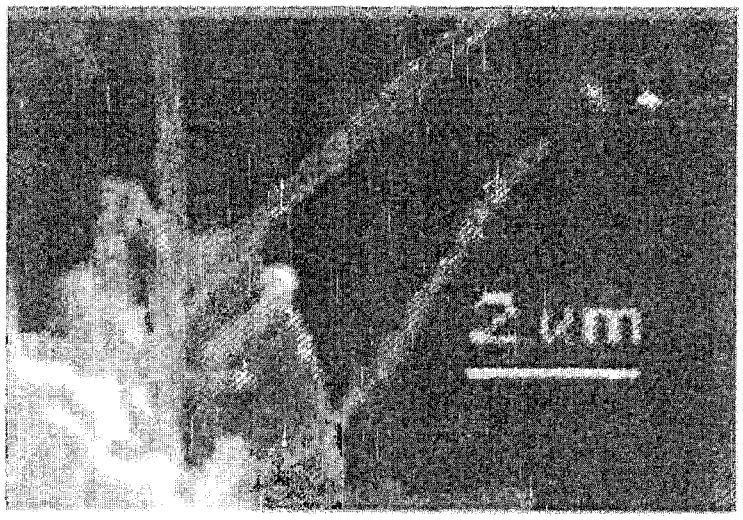
FIG. 8 shows an SEM image of a portion of FIG. 7 taken at larger scale.

FIG. 6 is an SEM image of the test bed 1 having the carbon film formed according to Embodiment 1, and FIGS. 7, 8 are SEM images of the test bed 1 having the carbon film formed according to Comparative Example 2. All were taken before performing the release resistance measurement test. FIG. 8 is an enlarged photograph of a portion of FIG. 7, and the line in the lower right area of the photograph shows a length of 2 μm. This shows that performing the nanocarbon film forming process according to Comparative Example 2 forms a nanocarbon film containing fiber-shaped nanocarbons on the test bed 1. FIG. 6 is equivalent to an example in which the fullerene applying process has been further performed on the nanocarbon film of FIG. 7. Comparing FIG. 6 and FIG. 7, surface unevenness has been reduced in the carbon film of Embodiment 1 shown in FIG. 6. That is, this shows that application of fullerenes to the surface of the nanocarbon film fills in the unevenness of the nanocarbon film and smoothens the carbon film surface.

Considering the results of the release resistance measurement test of FIG. 5 together with the results of the SEM images of FIGS. 6, 7, and 8, it was conjectured that, in Embodiment 1, a lower releasing load was maintained for a greater number of moldings due to surface unevenness being mitigated by filling fullerenes into spaces in the nanocarbon film formed on the test bed surface, and by the fullerenes, which are highly effective in reducing release resistance, being trapped by the nanocarbon film which does not readily peel off the test bed surface.

(Sticking Test)

Figure 9:
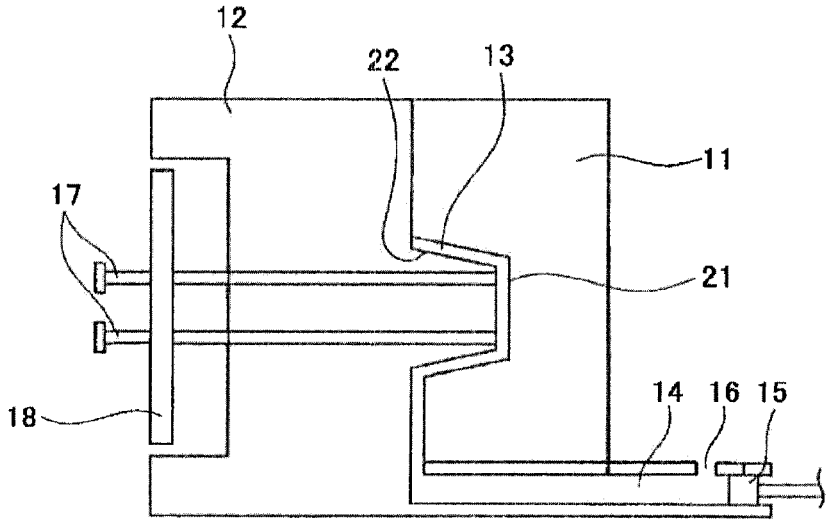
FIG. 9 shows a mold of a die casting device used in the embodiments and comparative examples.

In Embodiment 2 and Comparative Example 4, surface treatment was performed on a molding surface of a die casting mold for casting aluminum products, as shown in FIG. 9, and the occurrence of sticking during the die casting process for aluminum products was tested. The die casting mold was a mold manufactured from SKD61 for a housing of a transaxle of a motor vehicle, and ADC12 was used in the aluminum alloy that was cast. As shown in FIG. 9, the die casting mold used in the sticking test consisted of a fixed mold 11 and a movable mold 12. When the fixed mold 11 and the movable mold 12 have been clamped together, a space available between the fixed mold 11 and the movable mold 12 is a cavity 13, this cavity 13 being surrounded by a cavity surface 21 of the fixed mold 11 and a cavity surface 22 of the movable mold 12. A molten metal pouring path 14, plunger 15, and molten metal input hole 16 are formed in the fixed mold 11. A plate 18 and a cast removal pin 17 for removing the product after casting are formed in the movable mold 12. The surface treatment of Embodiment 2 and Comparative Example 4, described below, was performed on the cavity surfaces 21, 22 of the movable mold 11 and the fixed mold 12.

Embodiment 2

As in Embodiment 1, the nanocarbon film forming process and then the fullerene applying process were performed on the cavity surfaces 21, 22 of the fixed mold 11 and the movable mold 12, these constituting the die casting mold manufactured from SKD61 for casting a housing of a transaxle of a motor vehicle.

Comparative Example 4

Only the nanocarbon film forming process described in Embodiment 1 was performed on the cavity surfaces 21, 22 of the fixed mold 11 and movable mold 12 having the same material, shape, and size as Embodiment 2, and the fullerene applying process was not performed.

Sticking Test:

The die casting mold for a housing of a transaxle of a motor vehicle, which underwent the surface treatment in Embodiment 2 and Comparative Example 4, was repeatedly used for die casting aluminum products, and then was examined to see whether molten aluminum had stuck to the die casting mold.

A conventional silicon emulsion die lubricant was applied to the cavity surfaces 21, 22 of the fixed mold 11 and the movable mold 12, then the fixed mold 11 and movable mold 12 were clamped with a clamping pressure of 2000t. In the state of FIG. 9, the casting was performed by pouring molten aluminum (ADC12) into the molten metal pouring path 14 from the molten metal input hole 16, and using the plunger 15 to inject the molten aluminum at 670° C. into the cavity 13 with a casting pressure 46 MPa and injection speed 3 m/s. After the fixed mold 11 and the movable mold 12 were opened, the cast removal pin 17 (manufactured from SKD61) was moved in a direction of protruding from the cavity surface 22, and the cast aluminum product was removed. The procedures from applying the die lubricant to removing the molded product were treated as one sticking test shot, which was repeated.

After the sticking test was repeated, of the total surface area of the cavity surface 21 of the fixed mold 11 and the cavity surface 22 of the movable mold 12, the portion of surface area where molten aluminum stuck was examined, and is shown in Table 1. The sticking area in Table 1 shows a ratio calculated using, as 1, the surface area where sticking occurred in Comparative Example 4.

TABLE 1

| | number of shots | sticking surface area |
|---|---|---|
| Embodiment 2 | 100 | 0.2 |
| Comparative Example 4 | 50 | 1 |

As shown in Table 1, in using the die casting mold which underwent surface treatment in Embodiment 2, the sticking surface area was 0.2 that of the Comparative Example despite twice the number of shots than Comparative Example 4. That is, when using the casting mold having the carbon film created by the surface treatment method of the present invention, sticking of molten aluminum onto the casting mold during the aluminum casting could be significantly reduced.

As described above, when the casting mold surface treatment method of the present invention was performed, the effectiveness of reducing release resistance was maintained for longer, and the sticking of molten metal was inhibited. This was conjectured to be due to smoothening the unevenness of the surface by filling the fullerenes into the spaces in the nanocarbon film, and the fullerenes being trapped by the nanocarbon film. Smoothening was achieved by applying the fullerenes, which highly effectively reduce the release resistance, to the casting mold surface; this having been covered by the nanocarbon film which does not peel off readily. By lengthening the release effectiveness, the maintenance to restore the casting mold release effectiveness can be reduced, and the production efficiency in the casting process using the casting mold can be increased.

Moreover, the method of forming the nanocarbon film of the present invention is not restricted to the method using an atmospheric furnace, as in the above embodiments. Further, the method of applying the fullerenes is not restricted to the method of applying fullerene powder directly to the nanocarbon film, as in the above embodiments.

Specific examples of the present invention are described above in detail, but these examples are merely illustrative and place no limitation on the scope of the patent claims. The technology described in the patent claims also encompasses various changes and modifications to the specific examples described above.

The technical elements explained in the present specification or drawings provide technical utility either independently or through various combinations. The present invention is not limited to the combinations described at the time the claims are filed. Further, the purpose of the examples illustrated by the present specification or drawings is to satisfy multiple objectives simultaneously, and satisfying any one of those objectives gives technical utility to the present invention.

The invention claimed is:

1. A casting mold surface treatment method comprising applying fullerenes to a surface of a carbon film to trap the fullerenes in spaces in the carbon film, which covers a surface of a casting mold and contains at least one type of nanocarbon selected from the group consisting of carbon nanocoils, carbon nanotubes and carbon nanofilaments.

2. A casting mold surface treatment method comprising:

forming, on a surface of a casting mold, a carbon film containing at least one type of nanocarbon selected from the group of carbon nanocoils, carbon nanotubes and carbon nanofilaments, and applying fullerenes to a surface of the carbon film to trap the fullerenes in spaces in the carbon film.

3. The casting mold surface treatment method according to claim 1, wherein the applying fullerenes includes filling the fullerenes in the spaces in the carbon film to smooth unevenness of the surface side of the carbon film.

4. The casting mold surface treatment method according to claim 2, wherein the applying fullerenes includes filling the fullerenes in the spaces in the carbon film to smooth unevenness of the surface side of the carbon film.

5. The casting mold surface treatment method according to claim 2, further comprising forming, in the surface of the casting mold, a nitride film and a sulfurized film.

* * * * *